United States Patent [19]

Ippoliti et al.

[11] 4,187,703

[45] Feb. 12, 1980

[54] CONTAINER OF THE COMBINATION-LOCKED ENVELOPE TYPE

[75] Inventors: Ralph J. Ippoliti, Cornwells Heights; John J. Nelson, Bristol, both of Pa.

[73] Assignee: Product Dynamics, Ltd., Levittown, Pa.

[21] Appl. No.: 944,234

[22] Filed: Sep. 20, 1978

[51] Int. Cl.[2] ..... E05B 37/16; E05B 65/52

[52] U.S. Cl. ..... 70/63; 70/298; 206/1.5; 206/468

[58] Field of Search ..... 70/63, 287, 288, 298

[56] References Cited

U.S. PATENT DOCUMENTS

| | | | |
|---|---|---|---|
| 3,157,280 | 11/1964 | Perdue | 206/468 |
| 3,812,963 | 5/1974 | Zahuranec | 206/468 |
| 3,860,111 | 1/1975 | Thompson | 70/63 |

FOREIGN PATENT DOCUMENTS

| | | | |
|---|---|---|---|
| 401356 | 4/1966 | Switzerland | 206/468 |

*Primary Examiner*—Robert L. Wolfe

*Attorney, Agent, or Firm*—Frederick A. Zoda; John J. Kane; Albert Sperry

[57] ABSTRACT

A container in the form of a flat envelope, open at one end for insertion and removal of a slide, has a series of locking keys shiftable laterally to left or right from a normal, centered, rest position. When all the keys have been shifted in predetermined directions to positions representing a pre-set combination, the slide is freed for partial removal from the envelope, to an unlocking position that permits the object to be removed or in some cases to gravitate freely from the envelope. The device can be made inexpensively of injection molded plastic or plastic-coated cardboard, cheaply enough to allow it to be made as a single-use, disposable article.

17 Claims, 10 Drawing Figures

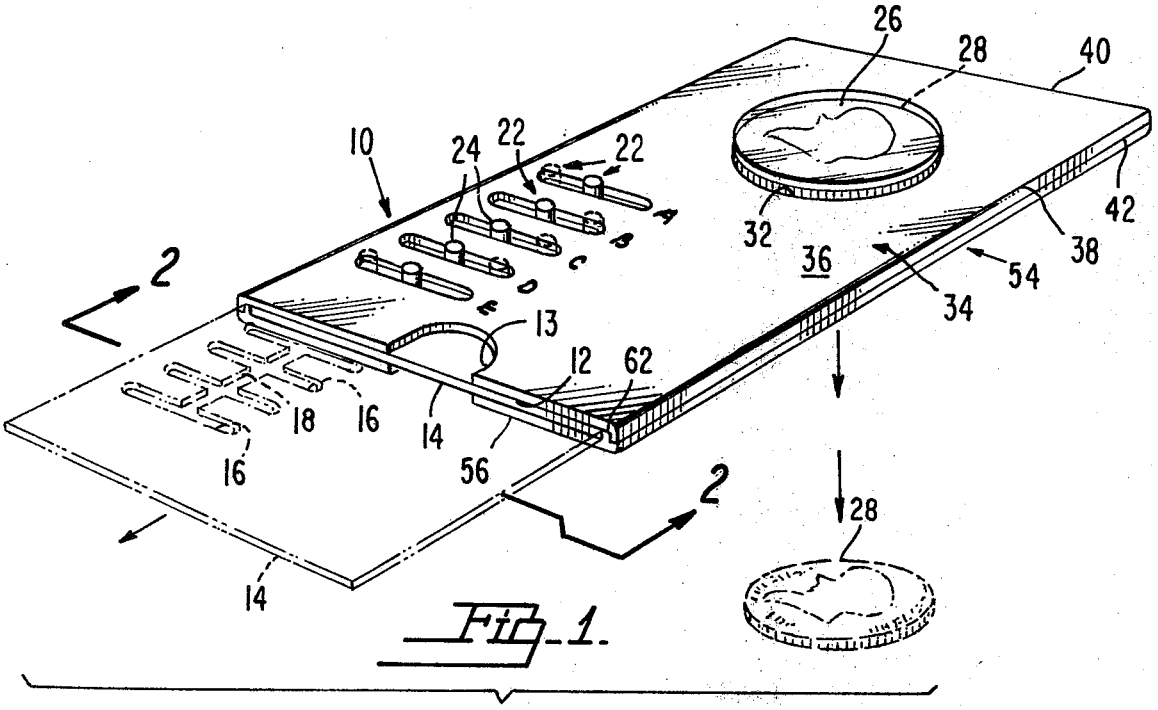
Fig. 1.
Fig. 2.
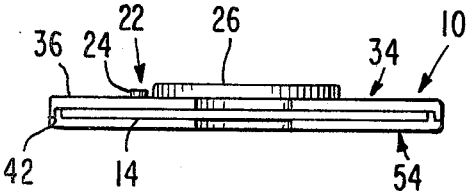
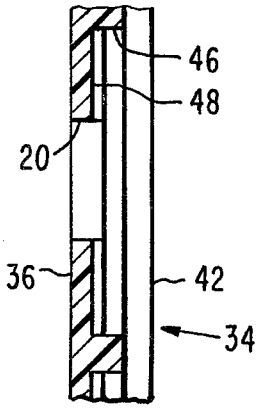
Fig. 5.
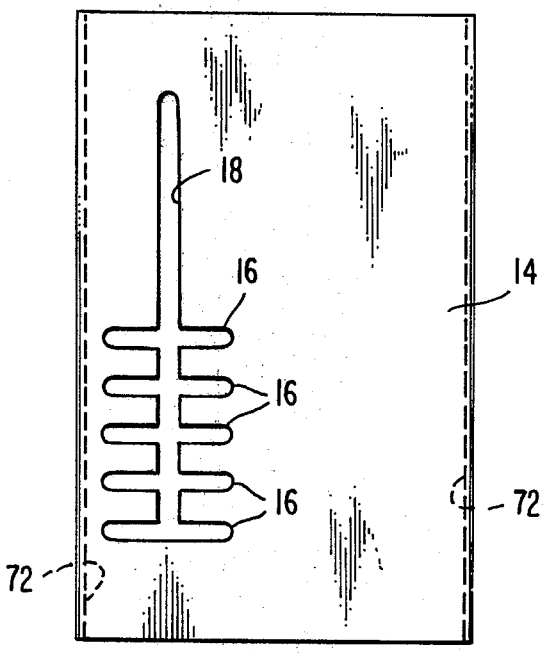
Fig. 6.

CONTAINER OF THE COMBINATION-LOCKED ENVELOPE TYPE

BACKGROUND OF THE INVENTION

1. Field of the Invention

The invention pertains generally to the art of special receptacles or packages, especially for small objects. In a more particular sense the invention relates to receptacles of the character described in which a locking means is incorporated, said locking means being of the combination type requiring correct re-positioning of a series of tabs or keys each of which is a barrier to movement of an object-locking member to its unlocking position. The lock is in that category of locking mechanisms wherein the locking tabs must all be shifted to unlocking positions in different directions so that they will no longer be interposed as barriers individually preventing unlocking of the container.

2. Description of the Prior Art

It has been heretofore proposed that special receptacles or packages for relatively small objects be of the type in which a slide is movable into and out of a flat, envelope-like container. It has further been proposed, in the lock art, to utilize a series of locking keys, shiftable in predetermined directions to unlocking positions. However, so far as is known the art has not in actuality gone past this point, so far as the present invention is concerned. In this connection, a problem has heretofore existed in respect to providing compact, inexpensive, special receptacles or packages for small objects, that can for example be used as part of an advertising campaign and hence are small enough to be sent through the mail or dispensed freely in public places. There has further been a need, heretofore, for designing such receptacles or packages in such fashion as to normally lock the object supported or contained therein. In some instances locking of the object is desirable for the purpose of piquing the interest of the recipient of the package, by creating a puzzle, so to speak, that must be solved before the receptacle can be opened. In other instances locking is desirable for the purpose of preventing children from obtaining access to medicaments or the like. In the provision of a receptacle that will have all of these attributes, it has at the same time been very important that the entire device be capable of manufacture at relatively low cost, and yet be adapted for incorporating therein a wide range of permutations of the locking mechanism. All of these problems should be capable of solution while keeping the overall cost of manufacture so low as to permit the receptacle to be made as a disposable, single-use article of manufacture, if desired. So far as is known, the prior art has not produced anything representing a full recognition of and a complete solution to the several problems noted.

SUMMARY OF THE INVENTION

Summarized briefly, the invention in a preferred embodiment comprises, first, a flat envelope that can be made of inexpensive molded plastic or plastic-coated cardboard, and that is formed open at one end. The envelope is formed during manufacture with an opening that is preferably disposed adjacent the closed end thereof. The opening receives the supported object, and hence is shaped in whatever configuration is necessary to receive that object.

The invention further includes a flat slide, also capable of manufacture from a sheet of plastic material or plastic-coated cardboard. The slide is inserted through the open end of the envelope, and when fully inserted lockably engages the supported object against removal from the opening provided in the envelope.

A series of identically formed locking keys or pins is incorporated in the device. Each of these has an operating tab or projection which is normally in a centered position. Each of the locking keys also has a locking lug which is concealed within the envelope, and which may be disposed to left or right of the operating tab, according to the particular permutation selected for the assembled device. Upon shifting of the operating tabs to their correct positions from their normal centered, rest positions, the locking lugs will be aligned within a longitudinal slot provided in the slide, and this will permit the slide to be partially extracted from the envelope. As a result, the slide will no longer be disposed as a barrier preventing removal of the supported object.

In this way, the invention solves problems previously existent in the prior art, with respect to providing locking-type containers, capable of manufacture at a cost low enough to permit them to be disposable, single-use articles while at the same time incorporating a combination lock in each container capable of being pre-set within a wide range of locking permutations. The invention further solves problems that have persistently surfaced, in arts such as the dispensing of medicaments that may be dangerous to children, or that can be taken only by those having the requisite alertness to operate a combination lock. This situation may arise, for example, with respect to individuals who due to loss of mental alertness may tend to over-medicate themselves through too-frequent use of prescription drugs.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a perspective view of a container according to the present invention, the supported object and slide being shown in full lines in locked position and in chain-dotted outline in their unlocked positions in respect to the envelope;

FIG. 2 is an end elevational view of the assembled device as seen from the line 2—2 of FIG. 1;

FIG. 5 is an enlarged, detail sectional view taken substantially on line 5—5 of FIG. 3;

FIG. 6 is a top plan view of the slide per se;

DESCRIPTION OF THE PREFERRED EMBODIMENTS

Figure 3:
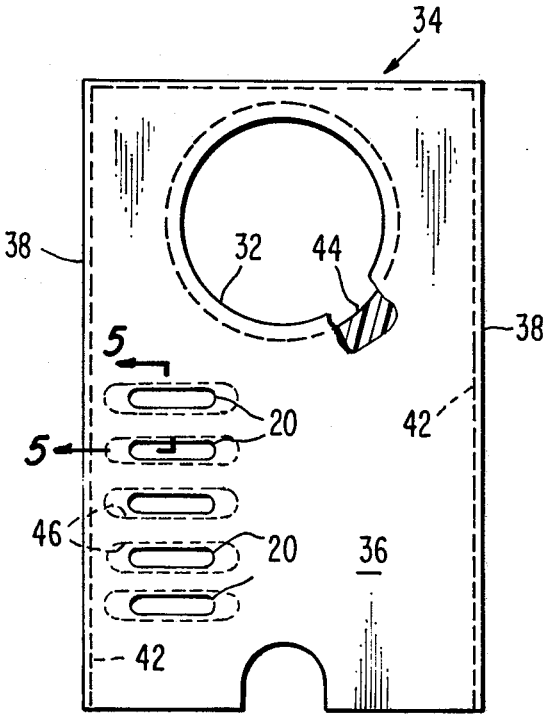
FIG. 3 is a top plan view of the top piece of the envelope, per se.

The device comprising the present invention, considered in its general aspects as distinguished from the specific structure thereof, may appropriately be considered as incorporating a generally rectangular, flat envelope or housing 10 one end of which is formed open as at 12. The open end 12 of envelope 10 is formed with an access notch or recess 13 adapted to receive the thumb and index finger of a user, for the purpose of grasping a rectangular, flat slide plate an end of which extends across the access notch 13 so as to facilitate grasping thereof when the slide plate is to be partially withdrawn to the dotted line position shown in FIG. 1.

The slide is illustrated per se in FIG. 6. It is proportioned to be snugly, slidably inserted in the envelope, to completely fill the interior thereof. Formed in the slide is a series of parallel, relatively short cross slots 16, disposed in the illustrated example adjacent one longitudinal edge of the slide, in intersecting, communicating relation with an elongated longitudinal slot 18 one end of which terminates at one end of the series of transverse slots 20, the other end of the longitudinal slot being disposed a substantial distance beyond the opposite end of said series. The longitudinal slot is disposed to communicate with the transverse slots medially between the opposite ends of each transverse slot.

Formed in the front face of the envelope is a corresponding series of transverse slots 20. The slots 20 correspond in number with and are in registration with the several slots 16 of the slide plate, and are adapted to receive locking keys 22.

The several locking keys are all identically formed, and may be molded from plastic material in a preferred embodiment. Each of the keys includes a flat, elongated, oblong body 23, integrally formed medially between its ends with a forwardly projecting handle having the form of a short, cylindrical pin or lug 24.

Figure 8:
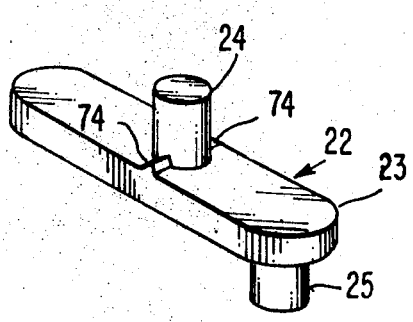
FIG. 8 is an enlarged, perspective view of one of the locking keys.
Figure 9:
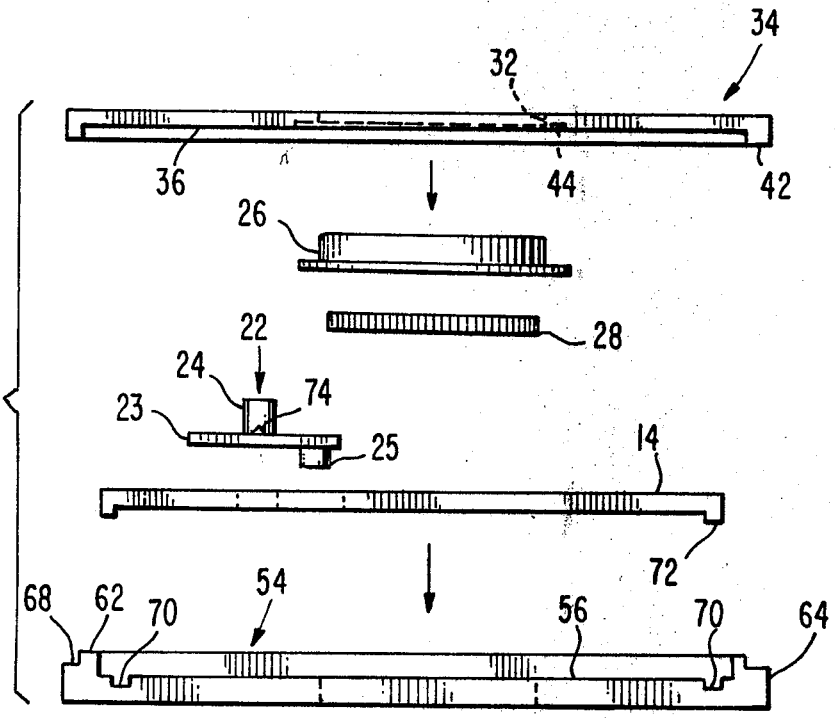
FIG. 9 is an exploded end elevational view of the complete device illustrating the procedure of assembling the same.

Also integrally formed on each locking key 22 is a locking lug 25. Each lug 25 is formed upon an end of the body 23 of its associated key, extending rearwardly therefrom as best seen in FIGS. 8 and 9.

In the assembled relation of the parts, the several locking keys 22 are arranged with their handles 24 projecting forwardly through the slots 20 of the envelope. The locking lugs 25 of the several keys 22 project rearwardly into the several slots 16 of the slide plate. The keys 22, in this connection, are all identically formed. However, in assembling the device, some of the keys are inserted with their locking lugs to the right of the handle, while the remaining keys are inserted with their locking lugs disposed to the left. The user of the device is unable to ascertain whether the locking lugs are disposed to the right or to the left, and as a result, in assembling the device any of a substantial number of combinations can be selected, in which the keys will all normally have their handles 24 disposed in line, medially between the opposite ends of the several, associated slots 20, as shown in full lines in FIG. 1. The several slots 20, in this connection, can be provided with alphabetical indicia, as shown in FIG. 1, so that the slots in the present instance may be lettered A, B, C, D and E. Key 22 of slot A can be disposed with its lug 25 to the right of the key handle; in slot B, the locking lug may be at the left; in slot C, at the left; in slot D, at the left; and in slot E, at the right. This is only one of 32 permutations that can be utilized in the illustrated example. The number of permutations can be increased, of course, by forming the envelope and the slide plate with additional transverse slots. For that matter, it is possible, to provide still additional permutations, to have a second series of transverse slots formed in the slide and envelope, at the side opposite that in which the illustrated single series of slots appears in FIG. 6. In other words, the arrangement of longitudinal and transverse slots shown at the left in FIG. 6 could be duplicated at the right of the longitudinal center line to multiply the number of permutations still further without increasing the size of the device, and with very little increase in material costs and in the cost of assembly.

The package is adapted to lockably confine, in a conspicuously displayed location, one or more objects 28. In FIG. 1, the object 28 is a coin, and is displayed within a thin-walled, generally flat, circular blister 26, integrally formed with an outwardly projecting peripheral flange 30.

The blister projects forwardly through a correspondingly circularly shaped display opening 32 formed in the envelope. The back of the envelope has a corresponding opening 33. In its fully inserted position, slide plate 14 extends across and blocks the rear opening 33, with the coin and blister being supported within the envelope in front of the slide. The rear opening 33 corresponds in diameter in the illustrated example to the diameter of the front opening 32, and as a result, if the proper combination is used and all the locking keys are shifted to the their correct dotted line positions in FIG. 1, all the lugs 25 thereof will be aligned within the longitudinal slot 18. This frees the slide for partial removal, to the dotted line position shown in FIG. 10, and by the partial extraction of the slide, the rear opening 33 is caused to be uncovered. The coin 28 is thus freed to gravitate through the back of the envelope as shown in FIG. 1.

When one considers the construction in a more particular fashion, it is appropriate to note that the envelope, and the slide plate, can be formed from inexpensive material, such as a relatively thin cardboard or the like, coated with a transparent plastic for the purpose of imparting suitable rigidity and durability thereto at a very low cost. This, it may be noted, permits the material of the envelope to be appropriately colored, and imprinted with suitable advertising legends or the like, thereby particularly adapting the device for use as a complementary package for use in dispensing samples of new products or alternatively usable in any of various other ways, as for example, for the purpose of dispensing a coin while calling attention of the recipient to a suitable advertising message.

The device may be further usable to advantage in the sale of such items as small vials of pills or tablets, refill razor blade cartridges, and indeed, for an almost limitless number of small objects to be sold, given away, or dispensed.

Considering these various possible end uses of the device, the importance of permitting manufacture of the device, while imparting thereto the capability of conveying a printed message, becomes clearly apparent. For this reason, the device has been specifically designed to make use of such inexpensive materials as the aforementioned plastic-coated cardboard, both for the envelope 10 and the slide plate 14.

Or, if desired, both the envelope and the slide plate can be made of molded plastic rather than of a plastic-coated cardboard or the like.

It is appropriate at this point to note the construction of the envelope, and by reference to FIGS. 2 through 5, it may be observed that the envelope in the illustrated example includes a front or face element 34 formed with a rectangular, flat body 36 integral along its longitudinal edges 38, and along the closed end 40 of the envelope, with a continuous, rearwardly projecting, low lip 42. Adjacent the closed end 40 of the envelope, the face element 34 is formed with the display opening 32 previously referred to herein. In this connection, and referring particularly to FIGS. 3 and 4, it will be observed that formed in the rear surface or underside of the face element 34 is a continuous, shallow locking recess 44 extending fully about the display opening 32 and formed to a diameter slightly greater than that of the display opening.

The face element 34 of the envelope 10, as previously noted herein, has the series of transverse slots 20, each of which extends entirely through the material of the facing element, as best shown in FIG. 5. Each of the slots 20 opens rearwardly into a shallow clearance recess or depression 46 formed in the underside of the facing element 34, and adapted to provide a slide way for the body 23 of its associated locking key 22.

Figure 4:
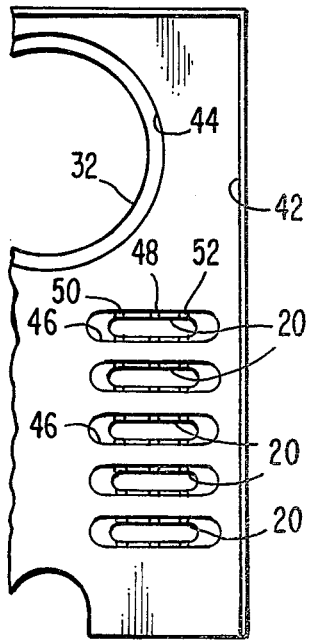
FIG. 4 is a fragmentary bottom plan or back view of the top piece.

Referring to FIG. 4, also integrally formed in the underside of the facing element, within each of the clearance recesses 46, is a series of three indexing recesses comprising a first or centered indexing recess 48, a right side recess 50, and a left side recess 52. These are for the purpose of indexing the locking keys between their normal centered locking positions shown in full lines in FIG. 1, and their left or right unlocking positions denoted by the indexing recesses or notches 52, 50 respectively.

Figure 7:
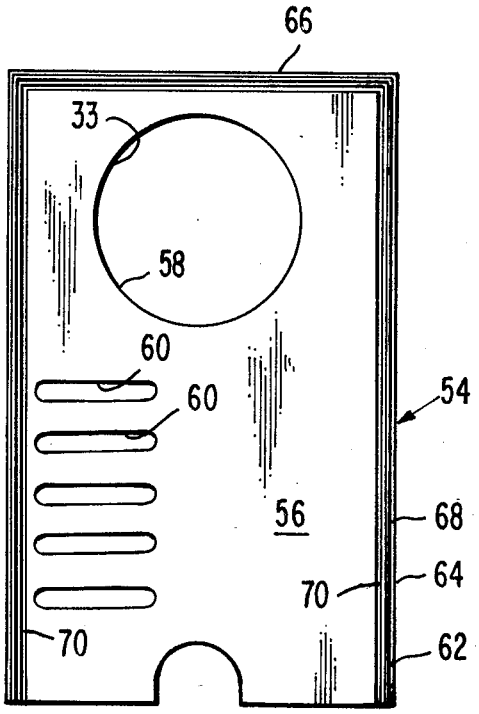
FIG. 7 is a top plan view of the bottom piece of the envelope, per se.

Considering now the construction of the rear or backing element 54 of the envelope 10, this is shown to particular advantage in FIGS. 7 and 9. The backing element 54 includes a flat, rectangular body 56 formed with a circular dispensing or access opening 58 for the supported object 28. The opening 58 corresponds in shape to the object to be released when the proper combination is found and the slide 14 is partially removed to the dotted line position of FIG. 1. Accordingly, in the example so far discussed, the object being a circular coin 28, the dispensing opening 58 is correspondingly circularly shaped, to a diameter equal to that of the opening 32 formed in the front of the envelope.

The backing element 54 is further formed, adjacent one longitudinal edge thereof, with a series of transverse, shallow, guide recesses 60 for the locking lugs 25. These recesses do not go all the way through the body 56, as will be understood, since it is important that the disposition of the locking lugs, to right or left as the case may be, is not to be known to the user.

Also integrally formed upon the backing element is a flange or lip 62 extending continuously along the longitudinal or side edges 64 and across one end edge 66. Flange 62, as shown in FIG. 9, is disposed inwardly from the side edges 64 and end edge 66, to provide a shallow peripheral recess 68 mating with the lip 42 of the facing element 34.

Also, as best shown in FIG. 9, the backing element 54 is formed with a pair of shallow, longitudinal slide ways or grooves 70, located inwardly from and in closely spaced parallel relation to the respective longitudinal edges 64, to receive longitudinal slide rails or flanges 72 integrally formed upon the respective longitudinal edges of the slide plate 14.

Slide plate 14 is illustrated per se in FIG. 6. The formation and relative arrangement of the cross slots 20 and longitudinal slot 18 thereof have already been discussed herein. The slide plate is otherwise imperforate, so that when the slide plate is fully inserted, it will completely cover the dispensing opening 58 formed in the backing element 54 of the envelope.

When the slide plate is freed for partial extraction from the envelope to the dotted line, unlocking position shown in FIG. 1, the rails or guide flanges 72 thereof within the respective grooves 70 in the illustrated, preferred embodiment.

In assembling the device (see FIG. 9), the slide plate is first positioned upon the backing element 54, with its rails 72 seated within the grooves 70. With the slide plate in its fully inserted or housed position, the several locking keys 22 are now disposed with their locking lugs extending rearwardly through the associated cross slots 16 of the slide plate. The distal ends of the locking lugs seat in the guide recesses 60 formed in the backing element.

The assembler selects the particular locking combination, during this step of the assembly of the complete device. The assembler can, thus, select any of 32 combinations in the illustrated example, as for example A right, B left, C left, D left, and E right. This is done merely by reversing a particular locking key end for end, to dispose the locking lug to the left or right of the handle, whichever is desired. Nothing else is required during the assembly of the device to pre-set the particular combination required to unlock the slide and permit its partial removal.

The bodies of the several locking keys will be disposed above the plane of the slide, viewing the same as in FIG. 9.

The object 28 to be dispensed is supported upon the slide plate, and the blister is positioned over the object. Then, the facing element 34 is positioned in overlying relation to the blister and the slide plate, the blister projecting upwardly through the display opening 32.

In some instances, it may be desired to pre-assemble the facing element with the blister and the supported object, before applying the facing element in assembled relation to the slide plate and backing element 54.

In any event, the facing element is disposed, as shown in FIG. 2, with its peripheral flange or lip 42 engaging in the peripheral recess 68 of the backing element, in interfitting or interengaged relation to the lip 62 of the backing element. By means of a suitable bonding expedient, as for example an appropriate adhesive or an ultrasonic weld, the cover plate or facing element is permanently assembled with the backing plate or element 54.

During assembly, the several locking keys are all disposed with indexing ribs 74 thereof (see FIG. 8) engaged in the center or neutral indexing recess 48. This locates all of the handles of the locking keys in longitudinal alignment with the hidden slot 18 formed in and extending longitudinally of the slide plate.

As a result, all of the locking lugs of the keys are disposed to left or right of the longitudinal slot 18, and are confined wholly within the cross slots 16 of the slide plate. Obviously the slide plate is incapable, under these circumstances, of being extracted from the envelope. The result is that the object 28 is locked in its housed position, against being dispensed from the envelope, and the user is denied access until such time as the correct combination is found.

Assuming that the user finds the correct combination one of which has been given by way of example above and is illustrated in the dotted positions of the key handles in FIG. 1, all of the locking lugs will be shifted to the center, in longitudinal alignment with and within the longitudinal slot 18 of the slide plate. When the locking keys are moved to left or right, the user will be given a tactile reference as to the extent to which the locking lugs should be moved, by reason of the snapping of the indexing ribs 74 into the left or right indexing recesses 52, 50 respectively.

The provision of the indexing recesses and indexing ribs has the further desirable result of retaining the keys in the positions to which they are moved from their normal, centered positions shown in full lines in FIG. 1. Indeed, the central indexing recesses are also of importance in that they maintain the locking keys in their centered positions during shipment, up until the time the device comes into the hands of the ultimate user.

As previously noted, once the correct combination is found, all the locking lugs will be now disposed in the longitudinal slot 18. This permits the slide to be partially extracted, to the extent permitted by the length of the longitudinal slot 18. The dispensing opening at the rear of the envelope is thus uncovered, and the object 28 may fall out as shown in dotted lines in FIG. 1.

It will be understood that the particular shape of the display opening 32 and of the dispensing opening 58, and also the shape of the locking recess 44, will vary according to the nature of the object to be dispensed. As a typical example, in FIG. 10 there is shown a device which is identical to that previously illustrated and described in every respect, except for the particular shape of the dispensing opening and display opening. In this form of the invention, the display opening has been designated 32*a*, and is of rectangular configuration. Projecting forwardly therethrough is a semi-cylindrical blister 26*a*, within which is displayed a cylindrical vial or bottle 28*a* containing a medication, either as an advertising sample or as a vial to be sold. The blister has a rectangular, outwardly projecting peripheral locking flange 30*a*, seating within a complementary locking recess 44*a*.

Figure 10:
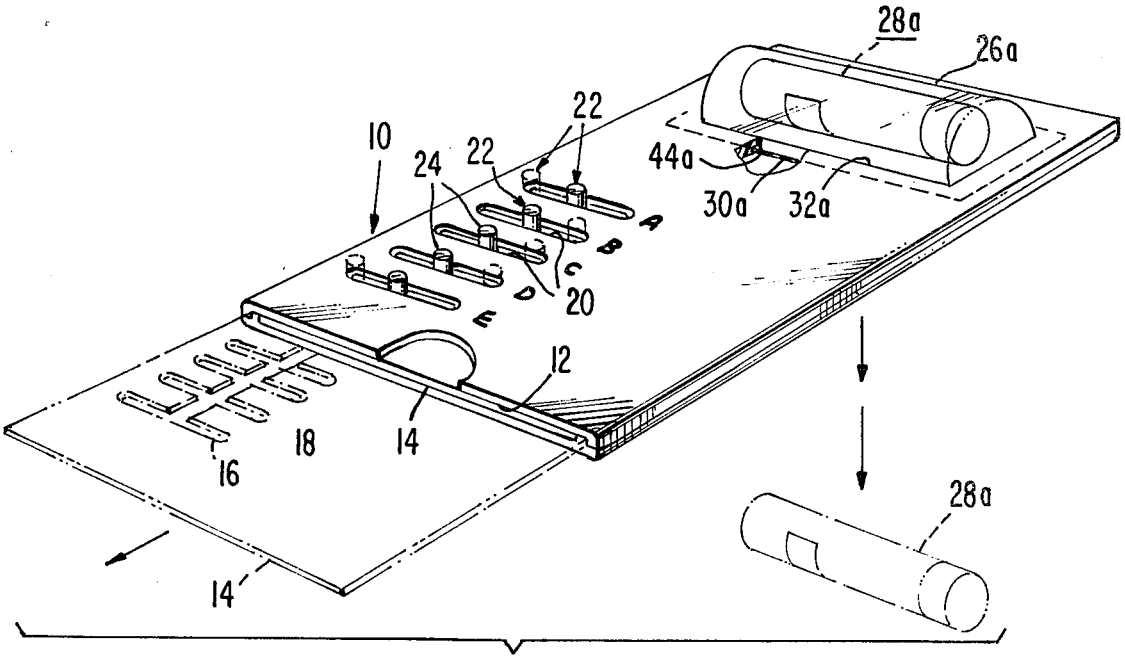
FIG. 10 is a view similar to FIG. 1 showing a modified construction.

When the slide illustrated in FIG. 10 is partially extracted, after the proper combination has been found, the vial 28*a* is permitted to gravitate through a rectangular dispensing opening, not shown, formed in the rear of the envelope, the shape and size of which will be selected according to the particular length and transverse dimension of the vial.

These are, of course, only two examples of a wide variety of objects, which may differ greatly in respect to size and shape, but in every instance the envelope will have dispensing openings, display openings, and blisters shaped according to the particular object that is to be locked within the device until the proper combination is found.

The device comprising the present invention has great significance in respect to the very low cost at which it can be assembled, and its compact size and form. Although it is a combination device with a large number of permutations possible, it still can be sent through the mail as an advertising sample, in a flat envelope or package that is exceedingly light and hence can be mailed at very low cost.

The device may also have other purposes, that is, it may be so designed as to require that the user have sufficient mental alertness to find a combination previously made known to the user. This may be of importance in respect to the dispensing of prescription medications. Alternatively, the provision of the combination has the desirable result of, for example, facilitating the opening of the package while assuring that it be locked under normal circumstances until it reaches the end user. Blister packages as heretofore made have often been extremely difficult to open, but in the present instance, upon moving the locking keys to the correct unlocking positions, the supported object simply gravitates from the package without necessity of tearing it open, a task which has heretofore been accompanied by considerable difficulty and resultant irritation to the user. In this event, a very simple combination may be used, requiring no more than two or three locking keys. Alternatively, the particular unlocking combination can be imprinted directly upon the device, so that the user can swiftly open the package and obtain access to the supported object.

In still other instances, it is within the spirit and usage of the invention to incorporate therein the aspects of a game or puzzle, so that the device can be sold to children and adults, with the idea that the proper combination needed to unlock the device must be found before the end user obtains access to the supported object.

The difficulty of the task can be readily varied, by the manufacturer, as desired.

In every instance, of course, the device has the desirable characteristic of being capable of manufacture at very low cost, and thus can even be a single use package to be disposed of after access is had to the enclosed object 28. Heretofore, combination locks, especially those permitting a substantial number of different locking combinations, have so far as is known been usable only in relatively expensive lock boxes or the like.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. A packaging device of the combination-lock type for lockably confining at least one article and for freeing the same responsive to the finding of a pre-set unlocking combination, comprising:

(a) a housing for said article having an opening through which the article may be removed;

(b) means within the housing normally extending as a barrier across the opening; and (c) a plurality of locking keys mounted in the housing in locking engagement with said means and operable through a pre-set combination to free said means for movement to a position in which the opening is uncovered and the article is freed for removal from the housing.

2. A packaging device as in claim 1 wherein the housing is in the form of a generally flat envelope, said means being in the form of a plate mounted in the envelope for sliding movement to said opening-uncovering position thereof.

3. A packaging device as in claim 2 wherein the envelope has one face formed with an aperture in which the article is displayed, the envelope having a second face in which said opening is formed, said aperture and opening being in registration with each other, said plate extending between said faces of the envelope between the article and said opening when positioned to bar the article against removal.

4. A packaging device as in claim 3 wherein said plate has a longitudinal slot, the locking keys having lugs normally disposed out of registration with said slot, the locking keys when moved to their unlocking positions being shiftable to dispose the lugs thereof in registration with the longitudinal slot, whereby to free the plate for movement to its opening-uncovering position.

5. A packaging device as in claim 4 wherein the plate has a plurality of transverse slots in communication with the longitudinal slot, said lugs of the locking keys being normally disposed in the transverse slots to prevent movement of the plate to its opening-uncovering position at any time in which at least one of the keys has its lug disposed in a transverse slot out of registration with the longitudinal slot.

6. A packaging device as in claim 5 wherein each locking key has a handle offset from the locking lug thereof, the handles of the several locking keys projecting through said one face of the envelope and being normally aligned when the lugs are disposed in the transverse slots, some of said handles being movable in one direction from their aligned relationship to locate the lugs in registration with the longitudinal slot, the remaining handles being movable in the opposite direction to locate the lugs thereof in registration with the longitudinal slot.

7. A packaging device as in claim 6 wherein each locking key includes a body extending longitudinally of the associated transverse slot of the plate, the locking lug of the key being extended in one direction from said body and the handle of the key being extended in the opposite direction from said body, said lugs being disposed in wholly concealed positions within the envelope to prevent a user from ascertaining the direction in which the handles should be shifted when the lugs are to be aligned with the longitudinal slot of the plate.

8. A packaging device as in claim 3, further including a transparent blister mounted within said aperture and engaged by said one face of the envelope against separation from the envelope, said blister being formed with an open back within the housing and being normally closed by the plate, whereby to confine the article between the plate and the blister when the plate is disposed as a barrier across the dispensing opening, movement of said plate to its opening-uncovering position being adapted to open the back of the blister for removal of said article.

9. A packaging device of the combination-lock type comprising:

(a) means for supporting at least one article and engaging the same against removal in one direction;

(b) a plate slidably engaged with said means and normally restraining the article against removal in an opposite direction; and (c) a series of locking keys engaging the plate against slidable movement in respect to said means from a position in which the plate bars removal of the article in said opposite direction, said keys being operable through a pre-set combination of movements to free the plate for slidable movement to a position freeing the article for removal in said opposite direction.

10. A packaging device as in claim 9 wherein the plate has a longitudinal slot concealed by said article support means, said locking keys having handles and locking lugs, the locking lugs being offset from the handles out of registration with said longitudinal slot in a first, normal, locking position of the locking keys, said locking keys when shifted from said first position thereof in a predetermined direction being adapted to dispose the lugs thereof in registration with the longitudinal slot to free the plate for movement to the position of the plate wherein the articles are freed for removal in said opposite direction.

11. A packaging device as in claim 10 wherein the plate is formed with a plurality of parallel, relatively short transverse slots intersecting medially between their ends with the longitudinal slot, each locking key being formed with a body disposed longitudinally of the associated transverse slot, the handles of the locking keys projecting forwardly from said bodies and the lugs extending rearwardly therefrom in offset relation to the handles, each locking key being reversible within its transverse slot during assembly of the plate and said means to establish a predetermined locking combination wherein some keys are movable in one direction transversely of the longitudinal slot and the remaining keys are movable in the opposite direction transversely of the longitudinal slot to dispose the lugs of all the keys in alignment with said longitudinal slot, whereby to free the plate for movement to its article-freeing position.

12. A packaging device as in claim 11 wherein said means is in the form of an elongated, flat envelope formed open at one end for slidable movement of the plate through the open end of the envelope.

13. A packaging device as in claim 12 wherein the plate extends in position to prevent removal of the article when the plate is fully inserted in the envelope, said plate being movable partially out of the envelope to a position freeing the article, when the lugs of all the locking keys are disposed in alignment with the longitudinal slot of the plate.

14. A packaging device as in claim 13 wherein said envelope comprises a facing element and a backing element between which the plate is slidably engaged, the backing element having a dispensing opening through which the article may be removed, the plate normally extending as a barrier across said dispensing opening, the facing element having a display opening in registration with the dispensing opening through which display opening the supported article is visible.

15. A packaging device as in claim 14 further including transparent blister means normally covering said display opening, the blister means receiving the article and being engaged between the facing element and the plate so as to prevent removal of the article through the display opening, said plate when fully inserted within the envelope being disposed as a barrier across the blister means to confine the article within the blister means, said plate on movement of all the locking lugs into alignment with the longitudinal slot, being shiftable partially out of the envelope to uncover the dispensing opening for removal of the supported article.

16. A packaging device of the combination-lock type comprising:

(a) an elongated envelope formed open at one end thereof, said envelope comprising a facing element and a backing element permanently connected along the sides and the opposite end of the envelope, said elements being disposed in closely spaced relation to define a shallow cavity within the envelope between the facing and backing elements thereof, said facing element and backing element being formed with registering display and dispensing openings respectively, said openings being spaced from the open end of the envelope, the facing element including a plurality of transverse slots;

(b) a slide plate mounted within said cavity for movement between a first position in which the slide plate is fully inserted in the envelope and is extended as a barrier across the dispensing opening formed in the backing element, said slide plate being movable to a second position in which it is partially withdrawn from the envelope and uncovers the dispensing opening for removal of a supported article, the slide plate having a longitudinal slot and having a series of transverse slots registering with the transverse slots of the facing element when the slide plate is in its inserted position; and (c) a series of locking keys, one for each transverse slot of the facing element, each locking key including an elongated body slidably mounted within the slots of the facing element between the facing element and the slide plate, each locking key further including a handle projecting forwardly through the associated slot of the facing element and mounted in a centered position on the body of the locking key, each locking key additionally including a locking lug extending rearwardly from the body thereof at one end of the body, the locking lugs of the several keys extending rearwardly within the envelope through the transverse slots of the slide plate when the several locking keys have their handles in alignment longitudinally of the envelope, some of said locking keys being disposed with their locking lugs offset laterally in one direction from the handles thereof and the remaining locking keys having their locking lugs disposed in laterally offset relation to their handles in the opposite direction, said handles when moved in a predetermined direction transversely of the envelope being adapted to dispose the lugs thereof in alignment with and in communication with the longitudinal slot of the slide plate, whereby to free the slide plate for partial removal from the envelope whereby to uncover the dispensing opening and free the supported article for removal.

17. A packaging device as in claim 16 wherein each locking key has an indexing projection, the facing element being formed with a plurality of indexing recesses in proximity to each transverse slot of the facing element, whereby said locking keys may be indexed from centered, locking positions thereof to unlocking positions laterally offset in opposite directions from the centered positions of the locking keys.

* * * * *